US008454394B2

(12) United States Patent
Iihoshi

(10) Patent No.: US 8,454,394 B2
(45) Date of Patent: Jun. 4, 2013

(54) TERMINAL FITTING HAVING AN AUXILARY RESILIENT PIECE

(75) Inventor: Shinji Iihoshi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 175 days.

(21) Appl. No.: 13/109,458

(22) Filed: May 17, 2011

(65) Prior Publication Data

US 2011/0294366 A1 Dec. 1, 2011

(30) Foreign Application Priority Data

May 27, 2010 (JP) ..... 2010-121900

(51) Int. Cl.
*H01R 11/22* (2006.01)

(52) U.S. Cl.
USPC ..... 439/852; 439/845

(58) Field of Classification Search
USPC ..... 439/852, 851, 845, 849, 839, 853
See application file for complete search history.

(56) References Cited

U.S. PATENT DOCUMENTS

| | | | | |
|---|---|---|---|---|
| 2,260,509 | A | 6/1940 | Chirelstein | |
| 5,540,603 | A * | 7/1996 | Fujiwara | 439/851 |
| 5,769,673 | A | 6/1998 | Ohta et al. | |
| 6,264,509 | B1 | 7/2001 | Kwang et al. | |
| 6,293,833 | B1 | 9/2001 | Kamath | |
| 7,458,864 | B2 * | 12/2008 | Philipp | 439/851 |
| 2005/0196983 | A1 * | 9/2005 | Fujii | 439/74 |

FOREIGN PATENT DOCUMENTS

| | | |
|---|---|---|
| JP | 63-56572 | 4/1988 |

* cited by examiner

*Primary Examiner* — Hae Moon Hyeon
(74) *Attorney, Agent, or Firm* — Gerald E. Hespos; Michael J. Porco; Matthew T. Hespos

(57) ABSTRACT

A terminal fitting (A) has a rectangular tubular terminal connecting portion (10) into which a tab (T) is to be inserted. A resilient contact piece (15) is folded to cantilever back from an end edge of a supporting plate (11) of the terminal connecting portion (10). A contact (20) is formed on the resilient contact piece (15). An auxiliary resilient piece (21) is formed by cutting a part of the resilient contact piece (15) and bending the cut part into resilient contact with the supporting plate (11) to increase a contact pressure between the contact (20) and the tab (T). The auxiliary resilient piece (21) is at a position before the contact (20) in an inserting direction of the tab (T) and closer to the supporting plate (11) than the contact (20) in a direction crossing the inserting direction of the tab.

10 Claims, 7 Drawing Sheets

TERMINAL FITTING HAVING AN AUXILARY RESILIENT PIECE

BACKGROUND OF THE INVENTION

1. Field of the Invention

The invention relates to a terminal fitting with a resilient contact piece.

2. Description of the Related Art

Japanese Unexamined Utility Model Publication No. S63-56572 discloses a female terminal fitting with a rectangular tubular terminal connecting portion and a resilient contact piece in the terminal connecting portion. A tab inserted into the terminal connecting portion from the front is brought into contact with the resilient contact piece. The resilient contact piece is folded back at the front end of a supporting plate of the terminal connecting portion to extend back in a direction oblique to an inserting direction of the tab. A contact is formed at a rear end portion of the resilient contact piece and contacts the properly inserted tab. A part of the resilient contact piece is cut and bent to form an auxiliary resilient piece in an area of the resilient contact piece before the contact. The auxiliary resilient piece is brought into contact with the supporting plate to increase a contact pressure between the resilient contact piece and the tab.

The cutting and bending of the resilient contact piece to form the auxiliary resilient piece leaves a cutout with a sharp edge. The auxiliary resilient piece is arranged before the contact. Thus, the tab may contact this sharp edge and be damaged in an inserting process of the tab.

The present invention was developed in view of the above situation and an object thereof is to prevent damage of a tab.

SUMMARY OF THE INVENTION

The invention relates to a terminal fitting with a tubular terminal connecting portion into which a tab is to be inserted. A resilient contact piece is folded back from an end edge of a supporting plate of the terminal connecting portion to cantilever substantially along an insertion path of the tab in the terminal connecting portion. A contact is formed on the resilient contact piece and contacts the tab that has been inserted properly in the terminal connecting portion. An auxiliary resilient piece is formed on the resilient contact piece to project toward the supporting plate and increases a contact pressure between the contact and the tab by resiliently contacting the supporting plate. The auxiliary resilient piece is before the contact in an inserting direction of the tab and closer to the supporting plate than the contact in a direction crossing the inserting direction of the tab. Accordingly, damage to the tab is prevented.

The auxiliary resilient piece preferably is formed by cutting a part of the resilient contact piece and bending the cut part toward the supporting plate. A cutout is left in the resilient contact piece as the auxiliary resilient piece is cut and bent and the cutout has a sharp edge that could damage the tab. However, the auxiliary resilient piece is at the position before the contact in the inserting direction of the tab and closer to the supporting plate than the contact in the direction crossing the inserting direction of the tab. Thus, the tab does not contact the sharp edge in an inserting process and damage to the tab is prevented.

An inclined portion preferably is formed in area of the resilient contact piece between the contact and an extending end. The inclined portion is inclined from the contact toward the extending end to approach the supporting plate gradually.

The inclined portion preferably is formed so that the extending end is not in contact with the supporting plate in a state where the tab is inserted properly. Thus, the lengths of the inclined portion and the resilient contact piece are short in the inserting direction of the tab. In other words, the terminal fitting of the invention is made smaller in the inserting direction of the tab.

The resilient contact piece preferably is cantilevered forward in the inserting direction of the tab into the terminal connecting portion and the auxiliary resilient piece is cantilevered backward in the inserting direction of the tab. Thus, the auxiliary resilient piece is located before the contact in the inserting direction of the tab and is arranged closer to the extending end than the contact. The area of the resilient contact piece between the contact and the extending end is involved in neither the insertion of the tab nor the contact with the tab. Thus, it is preferable to shorten this area maximally, thereby miniaturizing the terminal fitting. Accordingly, the auxiliary resilient piece extends back in the inserting direction of the tab, i.e. a direction opposite to an extending direction of the resilient contact piece in the invention. Therefore, the entire length of the resilient contact piece including the auxiliary resilient piece can be shortened as compared with the case where the auxiliary resilient piece extends forward in the inserting direction of the tab.

The auxiliary resilient piece preferably is not in contact with the supporting plate in a state where the resilient contact piece is not resiliently deformed.

In the inserting process of the tab, the resilient contact piece is deformed resiliently by the contact with the tab and the auxiliary resilient piece contacts the supporting plate to deform resiliently according to resilient deformation of the resilient contact piece. Thus, frictional resistance is created between the tab and the resilient contact piece by resilient restoring forces of the resilient contact piece and the auxiliary resilient piece and this becomes insertion resistance. However, the auxiliary resilient piece is not in contact with the supporting plate when the resilient contact piece is not deformed resiliently. Accordingly, no frictional resistance is created by the resilient restoring force of the auxiliary resilient piece when the tab starts the resilient deformation of the resilient contact piece. Therefore the insertion resistance is reduced by that much.

The auxiliary resilient piece preferably is substantially symmetric with respect to a center axis of the resilient contact piece in a width direction crossing both the inserting direction of the tab and a resilient displacing direction of the resilient contact piece. Thus, a resilient restoring force acting on the resilient contact piece from the auxiliary resilient piece does not become nonuniform in the width direction when the auxiliary resilient piece contacts the supporting plate and deforms resiliently. Therefore, the resilient restoring force of the auxiliary resilient piece will not incline the resilient contact piece.

An extending end of the resilient contact piece preferably can resiliently contact the supporting plate so that the resilient contact piece can be supported on the supporting plate at least at three points.

These and other objects, features and advantages of the invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
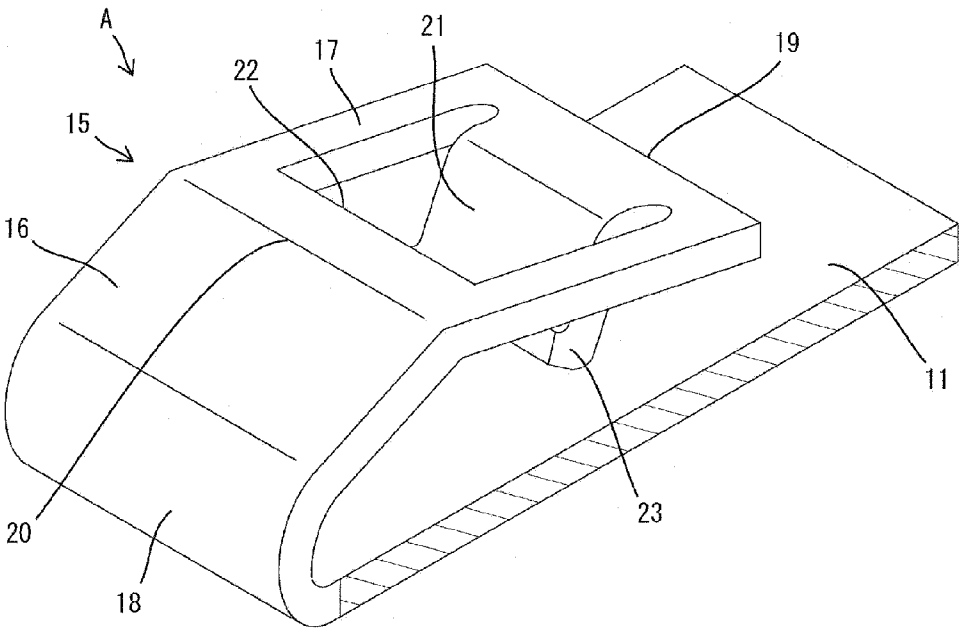
FIG. 1 is a perspective view of a resilient contact piece in a terminal fitting according to a first embodiment.
Figure 2:
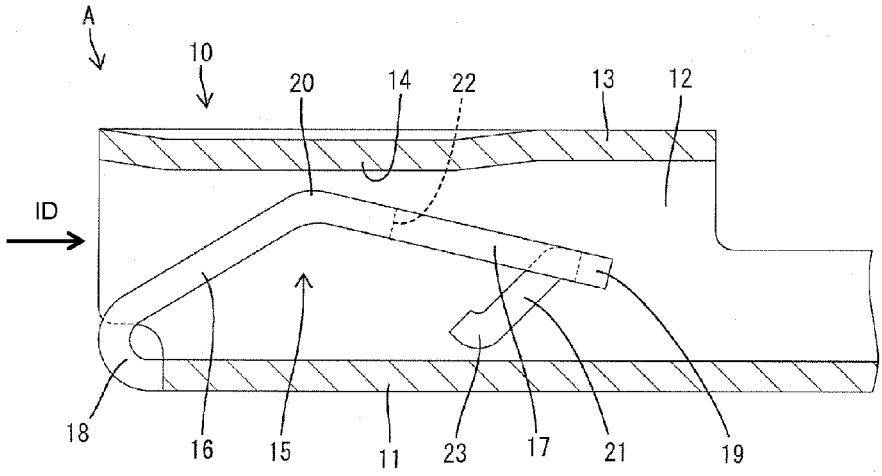
FIG. 2 is a section showing a state before a tab is inserted.
Figure 3:
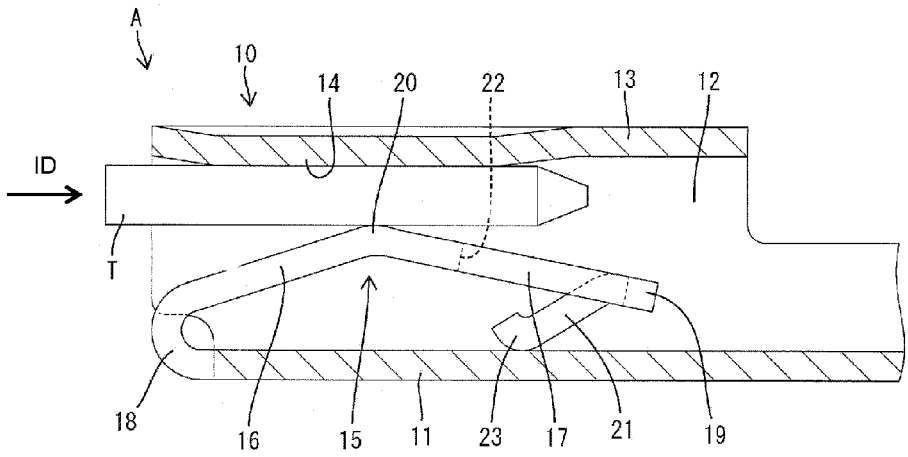
FIG. 3 is a section showing a state where the tab is inserted.

A female terminal fitting in accordance with a first embodiment of the invention is identified by the letter A in FIGS. 1 to 3. The terminal fitting A has a substantially rectangular tubular terminal connecting portion 10 and a resilient contact piece 15 accommodated in the terminal connecting portion 10. A tab T of a mating male terminal is insertable into the terminal connecting portion 10 from the front (left side in FIGS. 2 and 3) and along an insertion direction ID.

The terminal connecting portion 10 is a substantially rectangular tube with a supporting plate 11 that is long in forward and backward directions (directions parallel to an inserting direction ID of the tab T into the terminal connecting portion 10). Two side plates 12 project up from opposite left and right edges of the supporting plate 11 and a receiving plate 13 extends substantially parallel to the supporting plate 11 from the extending upper end edge of one side plate 12. A wire connection portion comprising an open crimping barrel (not shown) is connected to the rear end of the supporting plate 11, and a wire (not shown) is to be connected to this wire connection portion. A part of the receiving plate portion 13 is hammered, embossed or deformed to project down toward the interior of the terminal connecting portion 10 to form a receiving portion 14 substantially parallel to the inserting direction ID of the tab T.

The resilient contact piece 15 is folded back from the front end of the supporting plate 11 and is cantilevered toward a rear end of the terminal connecting portion 10 along an insertion path of the tab T in the terminal connecting portion 10. A flat front inclined portion 16 is formed at a front end part of the resilient contact piece 15 and a flat rear inclined portion 17 is formed at rear end part of the resilient contact piece 15. A first substantially arcuately bent first support 18 extends between the front end of the supporting plate 11 and the front end of the front inclined portion 16. Further, a free extending end 19 is cantilevered at the rear end of the rear inclined portion 17 of the resilient contact piece 15.

The front inclined portion 16 is oblique to the inserting direction ID of the tab T into the terminal connecting portion 10 and is inclined to become more distant from the supporting plate 11 from the front end toward the rear end of the front inclined portion 16. The rear inclined portion 17 also is oblique to the inserting direction ID of the tab T into the terminal connecting portion 10. However, the gradient of the rear inclined portion 17 is opposite to the gradient of the front inclined portion 16. Thus, the rear inclined portion 17 is inclined to approach the supporting plate 11 toward the rear extending end 19 of the rear inclined portion 17.

The rear end of the front inclined portion 16 and the front end of the rear inclined portion 17 are connected at an obtuse angle so that the resilient contact piece 15 is bent in a mountain shape when viewed sideways. A contact 20 is defined where the rear end of the front inclined portion 16 connects the front end of the rear inclined portion 17. The contact 20 is to be held in contact with the lower surface of the tab T when the tab T is inserted properly.

The contact 20 defines a ridge extending in a width direction of the resilient contact piece 15 (direction orthogonal to both the inserting direction ID of the tab T and the displacing direction of the contact 20 caused by resilient deformation of the resilient contact piece 15). In a state where the resilient contact piece 15 is not deformed, a distance between the contact 20 and the receiving portion 14 in a vertical direction orthogonal to the inserting direction ID of the tab T and parallel to the displacing direction of the contact 20 caused by resilient deformation of the resilient contact piece 15 is shorter than the thickness of the tab T.

The resilient contact piece 15 has at least one auxiliary resilient piece 21 for increasing a contact pressure between the contact 20 and the tab T by resiliently contacting the supporting plate 11. The auxiliary resilient piece 21 is formed by bending a substantially rectangular cut part of the resilient contact piece 15 toward the supporting plate 11. The auxiliary resilient piece 21 is formed in the rear inclined portion 17 of the resilient contact piece 15 and in an area behind the contact 20. More particularly, a cutout 22 substantially in the form of a rectangular window is formed in the rear inclined portion 17. The auxiliary resilient piece 21 is formed by this cutting and then is bent. The cutout 22 has a sharp edge.

The rear end of the auxiliary resilient piece 21 is connected to the rear inclined portion 17 of the resilient contact piece 15 and is cantilevered substantially forward toward the first support 18. In other words, the forward extending direction of the auxiliary resilient piece 21 is opposite to the backward extending direction of the resilient contact piece 15. Further, the auxiliary resilient piece 21 is inclined in a direction to approach the supporting plate 11 from the rear end to the front end of the auxiliary resilient piece 21. In other words, the auxiliary resilient piece 21 extends in a direction to become more distant from the contact portion 20 in the vertical resilient deformation direction. Thus, the inclination of the auxiliary resilient piece 21 is opposite to that of the rear inclined portion 17 when viewed sideways.

The vertical distance from the part of the rear inclined portion 17 where the auxiliary resilient piece 21 to the supporting plate 11 is less than the vertical distance from the contact 20 to the supporting plate 11. Additionally, the auxiliary resilient piece 21 extends from the rear inclined portion 17 toward the supporting plate 11. Thus, the auxiliary resilient piece 21 is arranged entirely in an area closer to the supporting plate 11 as compared to the position of the contact 20 relative to the supporting plate 11 (i.e. area more distant from the tab T than the contact 20).

The rear end of the auxiliary resilient piece 21 extends unitarily from the rear inclined portion 17 at a ridge extending in the width direction. A front extending end of the auxiliary resilient piece 21 is bent up away from the supporting plate 11 to form a second support 23. The lower surface of the second support 23 also defines a ridge extending in the width direction similar to the rear end of the auxiliary resilient piece 21. Further, the auxiliary resilient piece 21 is substantially bilaterally symmetric with respect to a center axis (not shown) of the resilient contact piece 15 in the width direction.

In a state where neither the resilient contact piece 15 nor the auxiliary resilient piece 21 is deformed resiliently, the second support 23 at the extending end of the auxiliary resilient piece 21 is spaced up from the supporting plate 11. A vertical distance along the resilient deformation direction between the second support 23 and the supporting plate 11 is shorter than a difference between the vertical distance between the contact 20 and the receiving portion 14 and the thickness of the tab T.

Neither the resilient contact piece 15 nor the auxiliary resilient piece 21 is resiliently deformed when the tab T is not inserted in the terminal connecting portion 10. Thus, the extending end 19 of the resilient contact piece 15 remains spaced up and inward from the supporting plate 11. Thus, the entire auxiliary resilient piece 21 including the second support 23 remains distanced from the supporting plate 11 and hence not in contact with the supporting plate 11.

The tab T can be inserted into the terminal connecting portion 10 in the inserting direction ID from the front in this state. As a result, the tab T first contacts the upper surface of the front inclined portion 16 and causes the resilient contact piece 15 to displace resiliently down around the first support 18 and toward the supporting plate 11. The second support 23 of the auxiliary resilient piece 21 contacts the supporting plate 11 as the resilient contact piece 15 is displaced resiliently. Thus, the resilient contact piece 15 is deformed resiliently to increase the angle between the front and rear inclined portions 16 and 17 and the auxiliary resilient piece 21 is deformed resiliently at its rear end.

The properly inserted tab T is sandwiched resiliently between the contact 20 and the receiving portion 14 and a specified contact pressure is ensured between the contact 20 and the tab T by resilient restoring forces of the resilient contact 15 and the auxiliary resilient piece 21. In this state, the extending end 19 of the resilient contact piece 15 is not in contact with the supporting plate 11.

As described above, the terminal fitting A of this embodiment has the substantially rectangular tubular terminal connecting portion 10 for receiving the tab T. The resilient contact 15 is folded at the front end of the supporting plate 11 of the terminal connecting portion 10 to cantilever back. The auxiliary resilient piece 21 resiliently contacts the supporting plate 11 and increases the contact pressure between the contact 20 and the tab T. The auxiliary resilient piece 21 is rearward of the contact 20 and a distance between the resilient contact piece 21 and the supporting plate 11 is less than a distance between the contact 20 and the supporting plate 11 in a direction crossing the inserting direction ID of the tab T.

The cutout 22 left by cutting and bending the resilient contact piece 15 to form the auxiliary resilient piece 21 has a sharp edge and the tab T could be damaged by contacting this sharp edge. However, the auxiliary resilient piece 21 is rearward of the contact 20 and the distance between the supporting plate 11 the auxiliary resilient piece 15 is less than the distance between the supporting plate 11 and the contact 20. Thus, the tab T does not contact the sharp edge in the inserting process and will not be damaged.

The rear inclined portion 17 of the resilient contact piece 15 is inclined to approach the supporting plate 11 gradually from the contact 20 toward the extending end 19. In this embodiment, the extending end 19 of the rear inclined portion 17 does not contact the supporting plate 11 when the tab T is inserted properly. This means that the length of the rear inclined portion 17 is short and, thus, the length of the resilient contact piece 15 is short in the inserting direction ID of the tab T. In other words, the terminal fitting A of this embodiment is small in the inserting direction ID of the tab T.

The resilient contact piece 15 is cantilevered substantially in the inserting direction ID of the tab T. Additionally, the auxiliary resilient piece 21 is rearward of the contact 20 and hence the extending end 19 is closer to the auxiliary resilient piece 21 than to the contact 20. The rear inclined portion 17 of the resilient contact piece 15 between the contact 20 and the extending end 19 is involved in neither the insertion of the tab T nor the contact with the tab T to maximally shorten this area in terms of miniaturization of the terminal fitting A. Thus, the auxiliary resilient piece 21 extends forward and the tab T is inserted in the direction substantially opposite to the extending direction of the resilient contact piece 15. Accordingly, the entire length of the resilient contact piece 15 including the auxiliary resilient piece 21 can be shortened as compared with the case where the auxiliary resilient piece 21 extends forward in the inserting direction ID of the tab T.

The tab T deforms the resilient contact piece 15 during the inserting process. This resilient deformation of the resilient contact piece 15 moves the auxiliary resilient piece 21 into contact with the supporting plate 11 and causes the auxiliary resilient piece 21 to be deformed resiliently. Resilient restoring forces of the resilient contact piece 15 and the auxiliary resilient piece 21 creates frictional resistance between the tab T and the resilient contact piece 15 and this becomes insertion resistance. In this embodiment, the auxiliary resilient piece 21 is not in contact with the supporting plate portion 11 in the state where the resilient contact piece 15 is not deformed. Accordingly, no frictional resistance is generated by the resilient restoring force of the auxiliary resilient piece 21 when the resilient deformation of the resilient contact piece 15 is started by the contact with the tab T. Therefore the insertion resistance is reduced by that much.

The auxiliary resilient piece 21 is substantially symmetric with respect to the center axis of the resilient contact piece 15. Thus, the resilient restoring force acting on the resilient contact piece 15 from the auxiliary resilient piece 21 is uniform in the width direction when the auxiliary resilient piece contacts the supporting plate 11 to be resiliently deformed. Therefore, the resilient restoring force of the auxiliary resilient piece 21 will not incline or twist the resilient contact piece 15.

Figure 4:
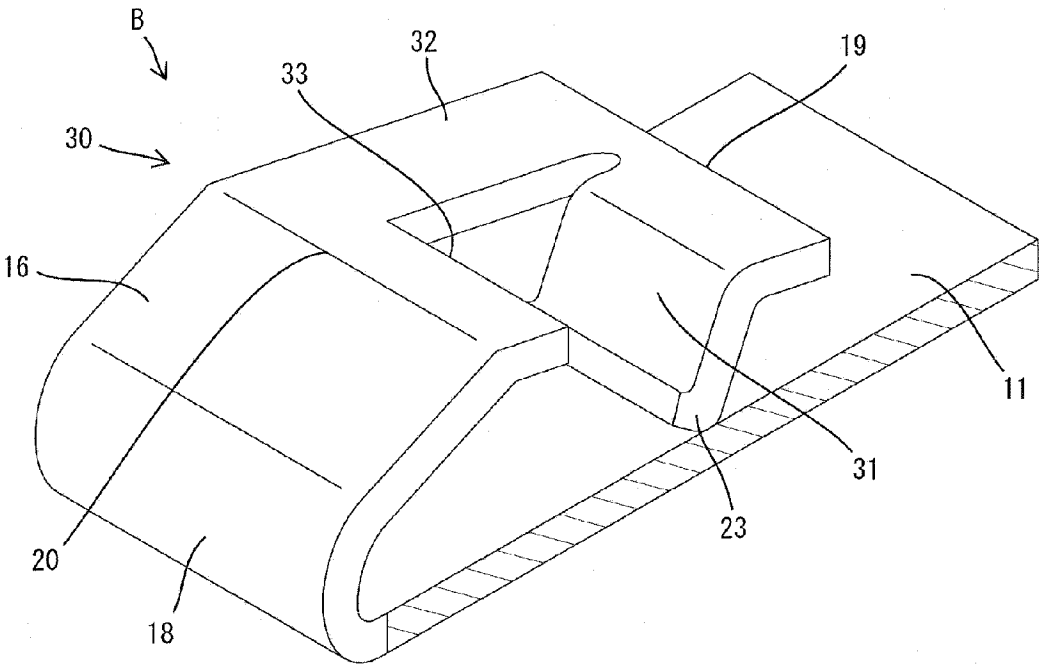
FIG. 4 is a perspective view of a resilient contact piece in a terminal fitting according to a second embodiment.

A terminal fitting in accordance with a second embodiment of the invention is identified by the letter B in FIG. 4. The terminal fitting B has a resilient contact piece 30 with an auxiliary resilient piece 31 formed in a rear inclined portion 32. Unlike the first embodiment, however, the auxiliary resilient piece 31 is shifted laterally from a center axis of the resilient contact piece 30. The formation of the auxiliary resilient piece 31 creates a cutout 33 in the rear inclined portion 32 and the cutout 33 is open at a lateral edge of the rear inclined portion 32. Other constructions, functions and effects are similar or substantially the same as in the first embodiment. These same constructions are identified by similar or the substantially same reference numerals and the structures, functions and effects thereof are not described.

Figure 5:
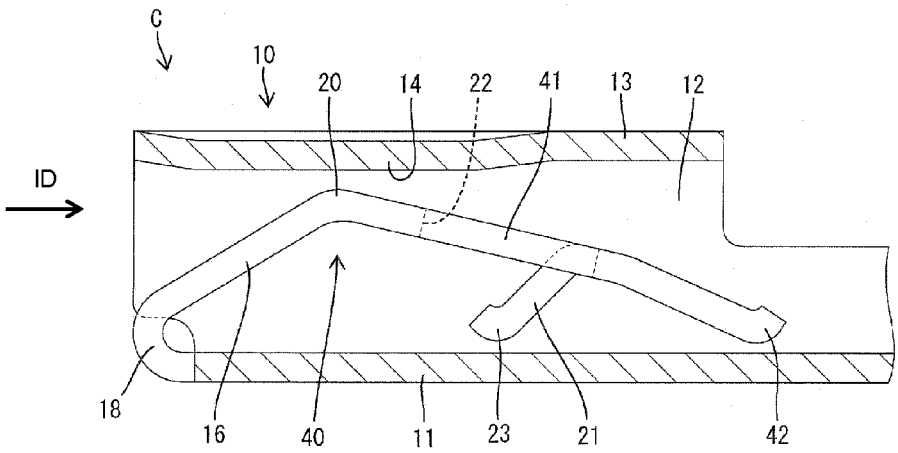
FIG. 5 is a section showing a third embodiment.

A terminal fitting in accordance with a third embodiment is identified by the letter C in FIG. 5. The terminal fitting C has a resilient contact piece 40 with a rear inclined portion 41 and an extending end 42. The extending end 42 of the resilient contact piece 40 resiliently contacts the supporting plate 11 when a tab T is inserted properly so that the resilient contact piece 40 is supported on the supporting plate 11 at three points, i.e. a first supporting point 18, a second supporting point 23 and the extending end 42. Further, the extending end 42 of the resilient contact piece 40 is not in contact with the supporting plate 11 when the resilient contact piece 40 is not deformed resiliently. Since other constructions, functions and effects are similar or the substantially same as in the first embodiment, similar or the substantially same constructions are identified by the same reference numerals and the structures, functions and effects thereof are not described.

Figure 6:
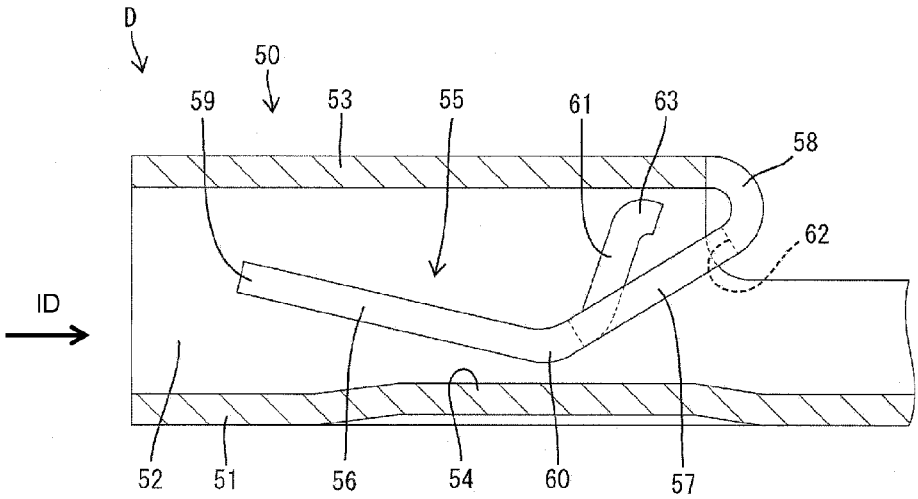
FIG. 6 is a section showing a fourth embodiment.

A terminal fitting in accordance with a fourth embodiment is identified by the letter D in FIG. 6. The terminal fitting C has a rectangular tubular terminal connecting portion 50 with a flat receiving plate portion 51 that is long in forward and backward directions (directions parallel to an inserting direction ID of a tab T into the terminal connecting portion 50). Two side plates 52 project up from opposite left and right sides of the receiving plate 51 and a supporting plate 53 extends substantially parallel to the receiving plate 51 from the extending upper end of one side plate 52. A wire connection portion (not shown) of a known form is connected to the rear end of the receiving plate 51, and a wire (not shown) is connected to the wire connection portion. A part of the receiving plate 51 is deformed or embossed to project up toward the interior of the terminal connecting portion 50, thereby forming a receiving portion 54 substantially parallel to the inserting direction ID of the tab T.

A resilient contact piece 55 is folded back at the rear end of the supporting plate 53 to cantilever toward a front end of the terminal connecting portion 50 along an insertion path (receiving portion 54) of the tab T in the terminal connecting portion 50. A front inclined portion 56 is formed at a front part of the resilient contact piece 55 and is substantially in the form of a flat plate. A rear inclined portion 57 is formed at a rear part of the resilient contact portion 50 and also is substantially in the form of a flat plate. An arcuately bent first support 58 is formed at the rear end of the rear inclined portion 57 and is connected to the rear end edge of the supporting plate 53. Further, an extending end 59 is formed at the free front end of the front inclined portion 56.

The front inclined portion 56 is oblique to the inserting direction ID of the tab T into the terminal connecting portion 50 and is inclined to become more distant from the supporting plate 53 from the front extending end 59 toward the rear end of the front inclined portion 56. On the other hand, the rear inclined portion 57 also is oblique to the inserting direction ID of the tab T into the terminal connecting portion 50. However, the gradient of the rear inclined portion 57 is opposite to the gradient of the front inclined portion 56 so that the rear inclined portion 57 is inclined to approach the supporting plate 53 from the front end toward the rear end of the rear inclined portion 57.

The rear end of the front inclined portion 56 and the front end of the rear inclined portion 57 are connected at an obtuse angle so that the resilient contact piece 55 is bent in a substantially valley shape when viewed sideways. A contact 60 is defined where the rear end of the front inclined portion 56 and the front end of the rear inclined portion 57 are connected. A distance between the contact 60 and the receiving portion 54 measured vertically or orthogonal to the inserting direction ID of the tab T is less than the thickness of the tab T. The contact 60 defines a ridge extending in a width direction of the resilient contact piece 55 and is held in contact with the upper surface of the tab T when the tab T is inserted properly.

The resilient contact piece 55 has an auxiliary resilient piece 61 that can resiliently contact the supporting plate 53 to increase a contact pressure between the contact 60 and the tab T. The auxiliary resilient piece 61 is made by forming a substantially U-shaped cut in a part of the rear inclined portion 57 of the resilient contact piece 55 and bending the cut part toward the supporting plate 53. Hence, the auxiliary resilient piece 61 is in an area behind the contact 60. The formation of the auxiliary resilient piece 61 creates a cutout 62 in the form of a substantially rectangular window hole in the rear inclined portion 57. The cutout 62 has a sharp edge.

The front end of the auxiliary resilient piece 61 is connected to the rear inclined portion 57 of the resilient contact piece 55 and the auxiliary resilient piece 61 then is cantilevered back from this front end substantially toward the first support 58. Thus, the rearward extending direction of the auxiliary resilient piece 61 relative to the inserting direction ID of the tab T is opposite to that forward extending direction of the resilient contact piece 55. Further, the auxiliary resilient piece 61 is inclined in a direction to approach the supporting plate 53 from the front end to the rear end of the auxiliary resilient piece 61. In other words, the auxiliary resilient piece 61 extends in a direction to become more distant from the contact 60 in the vertical direction.

A vertical distance between the supporting plate 53 and the area of the rear inclined portion 57 where the auxiliary resilient piece 61 is formed is less than a vertical distance between the supporting plate 53 than the contact 60. Additionally, the auxiliary resilient piece 61 extends from the rear inclined portion 57 toward the supporting plate 53. Thus, the supporting plate 53 is closer to all parts of the auxiliary resilient piece 61 than to the contact 60.

The front end of the auxiliary resilient piece 61 is connected unitarily to the rear inclined portion 57 to define a ridge extending in the width direction. A rear end portion of the auxiliary resilient piece 61 is bent down and away from the supporting plate 53 to form a second support 63. The surface of the second support 63 also defines a ridge extending in the width direction, similar to the front end of the auxiliary resilient piece 61. Further, the auxiliary resilient piece 61 is substantially bilaterally symmetric with respect to a center axis (not shown) of the resilient contact piece 55.

In a state where neither the resilient contact piece 55 nor the auxiliary resilient piece 61 is resiliently deformed, the second support 63 of the auxiliary resilient piece 61 is distanced down from the supporting plate 53 and not in contact with the supporting plate 53. A vertical distance between the second support 63 and the supporting plate 53 less than a difference between the vertical distance between the contact 60 and the receiving portion 54 and the thickness of the tab T.

Neither the resilient contact piece 55 nor the auxiliary resilient piece 61 is resiliently deformed when the tab T is not inserted in the terminal connecting portion 50. Thus, the extending end 59 of the resilient contact piece 55 is spaced down or in from the supporting plate 53 and is not in contact with the supporting plate 53 and the entire auxiliary resilient piece 61, including the second support 63 is kept distanced down from the supporting plate 53 and not in contact with the supporting plate 53. Since other constructions, functions and effects are similar or the substantially same as in the first embodiment, similar or the substantially same constructions are identified by the same reference numerals and the structures, functions and effects thereof are not described.

Figure 7:
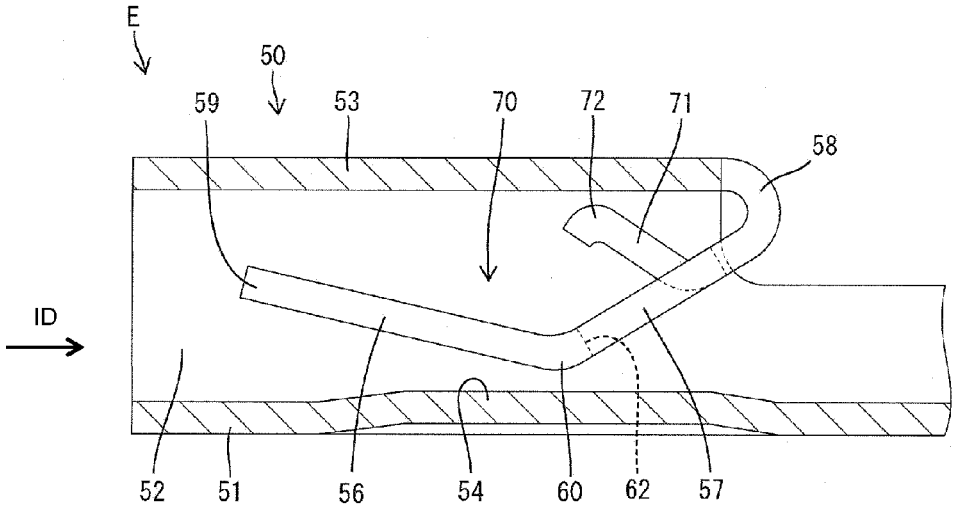
FIG. 7 is a section showing a fifth embodiment.

A terminal fitting in accordance with a fifth embodiment is identified by the letter E in FIG. 7. The terminal fitting E differs from the fourth embodiment in the construction of an auxiliary resilient piece 71. More particularly, the auxiliary resilient piece 61 is cantilevered backward in the fourth embodiment, whereas the auxiliary resilient piece 71 of this fifth embodiment is cantilevered forward.

The rear end of the auxiliary resilient piece 71 is connected to a rear inclined portion 57 of a resilient contact piece 55 and the auxiliary resilient piece 71 then is cantilevered forward to become more distant from a first supporting 58. In other words, in directions along an insertion path of the tab T (forward and backward directions), an extending direction of the auxiliary resilient piece 71 is the same as the forward extending direction of the resilient contact piece 70. Further, the auxiliary resilient piece 71 is inclined in a direction as to approach a supporting plate 53 from the rear end to the front end of the auxiliary resilient piece 71 (forward in the extending direction of the auxiliary resilient piece 71). In other words, the auxiliary resilient piece 71 extends in a direction to become more distant from the contact 60 in the vertical direction. Thus, the inclination of the auxiliary resilient piece 71 is substantially opposite to that of the rear inclined portion 57 when viewed sideways.

The rear end of the auxiliary resilient piece 71 is joined unitarily to the rear inclined portion 57 to define a ridge extending in the width direction. A front extending end portion of the auxiliary resilient piece 71 is bent down away from the supporting plate 53 to form a second support 72. The lower surface of the second support 72 also is in the form of a ridge extending in the width direction similar to the rear end of the auxiliary resilient piece 71. Since other constructions, functions and effects are similar or substantially the same as in the fourth embodiment, similar or the substantially same constructions are identified by the same reference numerals and the structures, functions and effects thereof are not described.

The invention is not limited to the above described and illustrated embodiments. For example, the following embodiments are also included in the scope of the invention.

Although one auxiliary resilient piece is formed in one resilient contact piece in the first to fifth embodiments, a plurality of auxiliary resilient pieces may be formed in one resilient contact piece. In this case, the plurality of auxiliary resilient pieces may be arranged in forward and backward directions (directions parallel to the inserting direction ID of the tab) or the width direction (direction crossing the inserting direction ID of the tab and the resilient deforming direction of the resilient contact piece) or may be shifted in both forward and backward directions and width direction.

Although the auxiliary resilient piece is not in contact with the supporting plate in the state where the resilient contact piece is not resiliently deformed in the first to fifth embodiments, the auxiliary resilient piece may be in contact with the supporting plate even in the state where the resilient contact piece is not resiliently deformed in these first to fifth embodiments.

Although the auxiliary resilient piece particularly is substantially symmetric with respect to the center axis of the resilient contact piece in the width direction in the first, third to fifth embodiments, it may be asymmetric in the width direction.

Although the contact portion particularly is a ridge substantially extending in the width direction of the resilient contact piece in the first to fifth embodiments, it may be an embossed (dome-shaped) projection.

The shifted arrangement of the auxiliary resilient piece from the center axis of the resilient contact piece in the width direction in the second embodiment may also be applied to the third, fourth and fifth embodiments.

The mode of supporting the resilient contact piece at three points by bringing the extending end of the resilient contact piece into resilient contact with the supporting plate portion with the tab properly inserted in the third embodiment may also be applied to the second, fourth and fifth embodiments.

Although the extending end of the resilient contact piece is not in contact with the supporting plate in the state where the resilient contact piece is not resiliently deformed in the third embodiment, it may be in contact with the supporting plate even in the state where the resilient contact piece is not resiliently deformed.

What is claimed is:

1. A terminal fitting, comprising:

a substantially tubular terminal connecting portion having a front end for receiving a tab and a rear end spaced from the front end along a tab inserting direction;

a resilient contact piece folded back substantially from an end of a supporting plate of the terminal connecting portion to cantilever substantially along an insertion path of the tab in the terminal connecting portion;

a contact formed on the resilient contact piece for contacting the tab properly inserted in the terminal connecting portion; and an auxiliary resilient piece formed on the resilient contact piece and projecting toward the supporting plate for increasing a contact pressure between the contact and the tab by resiliently contacting the supporting plate, the auxiliary resilient piece being arranged between the contact and the rear end of the terminal connecting portion and closer to the supporting plate than the contact in a direction crossing the inserting direction of the tab.

2. The terminal fitting of claim 1, wherein the auxiliary resilient piece is formed by cutting a part of the resilient contact piece and bending the cut part toward the supporting plate.

3. The terminal fitting of claim 1, wherein:

the resilient contact piece is cantilevered in the inserting direction of the tab into the terminal connecting portion; and the auxiliary resilient piece is cantilevered opposed to the inserting direction of the tab and toward the front end of the terminal connecting portion.

4. The terminal fitting of claim 1, wherein the auxiliary resilient piece is not in contact with the supporting plate in a state where the resilient contact piece is not resiliently deformed.

5. The terminal fitting of claim 1, wherein the auxiliary resilient piece is substantially symmetric with respect to a center axis of the resilient contact piece in a width direction crossing both the inserting direction of the tab and a resilient displacing direction of the resilient contact piece.

6. The terminal fitting of claim 1, wherein:

the resilient contact piece is cantilevered substantially opposed to the inserting direction of the tab into the terminal connecting portion to extend from a position in proximity to the rear end of the terminal connecting portion to a position closer to the front end of the terminal connecting portion; and the auxiliary resilient piece is cantilevered substantially in the inserting direction of the tab to extend toward the rear end of the terminal connecting portion.

7. The terminal fitting of claim 1, wherein:

the resilient contact piece is cantilevered substantially opposed to the inserting direction of the tab into the terminal connecting portion to extend from a position in proximity to the rear end of the terminal connecting portion to a position closer to the front end of the terminal connecting portion; and the auxiliary resilient piece is cantilevered in a direction substantially opposed to the inserting direction of the tab to extend toward the front end of the terminal connecting portion.

8. A terminal fitting, comprising:

a substantially tubular terminal connecting portion having a front end for receiving a tab and a rear end spaced from the front end along a tab inserting direction;

a resilient contact piece folded back substantially from an end of a supporting plate of the terminal connecting portion to cantilever substantially along an insertion path of the tab in the terminal connecting portion;

a contact formed on the resilient contact piece for contacting the tab properly inserted in the terminal connecting portion; and an auxiliary resilient piece formed on the resilient contact piece and projecting toward the supporting plate for increasing a contact pressure between the contact and the tab by resiliently contacting the supporting plate, the auxiliary resilient piece being arranged between the contact and the rear end of the terminal connecting portion and closer to the supporting plate than the contact in a direction crossing the inserting direction of the tab, wherein an area of the resilient contact piece has an inclined portion between the contact and an extending end, the inclined portion being inclined from the contact toward the extending end to gradually approach the supporting plate.

9. The terminal fitting of claim 8, wherein the inclined portion is formed so that the extending end does not contact the supporting plate in a state where the tab is inserted properly.

10. A terminal fitting, comprising:

a substantially tubular terminal connecting portion having a front end for receiving a tab and a rear end spaced from the front end along a tab inserting direction;

a resilient contact piece folded back substantially from an end of a supporting plate of the terminal connecting portion to cantilever substantially along an insertion path of the tab in the terminal connecting portion;

a contact formed on the resilient contact piece for contacting the tab properly inserted in the terminal connecting portion; and an auxiliary resilient piece formed on the resilient contact piece and projecting toward the supporting plate for increasing a contact pressure between the contact and the tab by resiliently contacting the supporting plate, the auxiliary resilient piece being arranged between the contact and the rear end of the terminal connecting portion and closer to the supporting plate than the contact in a direction crossing the inserting direction of the tab, wherein an extending end of the resilient contact piece can resiliently contact the supporting plate so that the resilient contact piece can be supported on the supporting plate at least at three points.

* * * * *